US006021591A

United States Patent [19]

Basile

[11] Patent Number: 6,021,591

[45] Date of Patent: Feb. 8, 2000

[54] COVER FOR STEAM IRON WITH OUTSIDE TANK

[75] Inventor: Salvatore Basile, Padoua, Italy

[73] Assignee: Vetrella SpA, Cazago Di Pianiga, Italy

[21] Appl. No.: 09/126,084

[22] Filed: Jul. 30, 1998

[30] Foreign Application Priority Data

Apr. 8, 1997 [IT] Italy ..... UD97A0142

[51] Int. Cl.[7] ..... D06F 75/40

[52] U.S. Cl. ..... 38/77.6

[58] Field of Search ..... 38/75, 77.2, 77.3, 38/77.6, 77.82, 79, 88, 94, 96, 107; 219/245, 246, 247, 248, 254, 259

[56] References Cited

U.S. PATENT DOCUMENTS

| | | | |
|---|---|---|---|
| 4,565,019 | 1/1986 | Cavalli | 38/77.6 |
| 5,315,773 | 5/1994 | Iwami et al. | 38/107 X |
| 5,832,639 | 11/1998 | Muncan | 38/77.6 |

FOREIGN PATENT DOCUMENTS

| | | | |
|---|---|---|---|
| 0 124 039 | 11/1984 | European Pat. Off. . | |
| 0 135 484 | 3/1985 | European Pat. Off. . | |
| 574602 | 12/1993 | European Pat. Off. | 38/77.3 |
| 3267099 | 11/1991 | Japan | 38/94 |
| 2 308 135 | 6/1997 | United Kingdom . | |

*Primary Examiner*—Ismael Izaguirre
*Attorney, Agent, or Firm*—Jacobson Price, Holman & Stern, PLLC

[57] ABSTRACT

Cover (10) for steam iron (11) of the type having an outside tank, whether incorporating a boiler or not, associated with a base (16), wherein the cover (10) is able to be associated temporarily with the base (16) in order to cover the iron (11) when the latter is not in use and defines at least a closed volume (12) to temporarily contain water (13) which can be selectively connected to the tank or boiler by an adduction device (23) which can be selectively activated when a predetermined minimum level of water inside the tank or boiler has been reached.

12 Claims, 1 Drawing Sheet

COVER FOR STEAM IRON WITH OUTSIDE TANK

FIELD OF THE INVENTION

This invention concerns a cover for a steam iron with outside tank.

The invention is used in association with the base of the tank, which may incorporate the boiler used to generate the steam, and performs the function of acting as a cover for the iron when it is not in use, and also serves as an auxiliary water tank to supply the boiler or to supply the main water tank when either one is finished or about to finish.

BACKGROUND OF THE INVENTION

The state of the art includes irons which are associated, by means of electric cables and an adduction pipe for water or steam, to a base which houses the tank or boiler to produce the steam and a possible electronic control system.

The bases for irons which are known to the art have a box-like shape and are equipped at the upper part and/or at the sides with a surface made of heat resistant and anti-slip material used to rest the iron on when it is not being used.

There are also bases equipped with spaces which can be closed, suitable to house the iron in a retracted position when not in use.

Irons known to the state of the art usually have tanks or boilers which, both for reasons of bulk and for reasons connected to the times needed to generate steam, have a limited capacity which, in the event of prolonged use, obliges the user to repeatedly re-fill the tank with water.

Normally, in the case of boilers, to ensure the refilling operations are carried out in conditions of safety for the user, it is possible to add fresh water only when the boilers have cooled down, or when the steam contained therein has lost its pressure.

This entails long unproductive periods, longer times required to bring the fresh water to evaporation point and therefore a greater consumption of electric energy.

Moreover, the fresh water is cold, and therefore requires a long time to heat up, thus further increasing the time when the iron is inactive.

In irons known to the state of the art, moreover, filling the boilers is not very practical inasmuch as the refilling aperture is generally very small and therefore it is necessary to use funnels or special recipients.

The present Applicant has designed, tested and embodied this invention to overcome the shortcomings of the state of the art and to obtain further advantages.

SUMMARY OF THE INVENTION

The purpose of the invention is to provide a cover for irons of the type with an outside tank, with or without a boiler, which, apart from the aesthetic and protective function of covering the iron when it is not in use, also serves as an auxiliary water container in order to facilitate and accelerate the operations of refilling the tank or the steam generation boiler.

The invention makes it possible to avoid those unproductive times of waiting for the boiler to cool and/or for the steam to lose pressure, to reduce the times necessary to bring the fresh water added to evaporation, to ensure greater safety for the user and to save electric energy.

The cover according to the invention has an operating position wherein it is arranged at the upper part of the containing base of the tank or boiler and covers the iron when it is not in use, improving the aesthetic appearance of the iron/base combination and protecting the iron itself.

Moreover, in its operating position the cover makes it possible to fill the tank or boiler automatically with fresh water when, for example, the water contained therein is finished or has gone below a pre-determined level.

For this purpose, the cover according to the invention defines inside a closed volume suitable to contain water.

According to one embodiment, the closed volume consists of a space defined by a double wall of the cover; the innermost wall defines in turn a containing seating substantially mating with the shape of the iron which allows it to be covered when it is not being used and is positioned above the afore-said base.

According to a variant the cover has only one wall defining inside a space to house a tank, or basin, to contain water.

The cover according to the invention has at the lower part adduction means for water, for example a nozzle, suitable to cooperate in a water-tight manner with a loading aperture made on the tank or boiler.

According to a variant, when the cover is in its operating position, the water adduction means are inserted inside the loading aperture of the tank or boiler.

The water is unloaded automatically from the cover, according to a variant, when the water contained in the tank or boiler is finished or has gone below a minimum level.

According to another variant, the automatic water adduction means are governed by sensors included for this purpose, for example, level sensors, pressure sensors, etc.

According to another variant, the water adduction means are activated manually by the user when, for example, the means signalling a lack of water, included on the iron or the base, are activated.

The invention makes it possible to considerably increase the irons' autonomy yet at the same time to use tanks or boilers of limited size and to maintain substantially unchanged the overall bulk of the base/iron combination.

With the cover according to the invention it is also possible to considerably facilitate the refilling of the tank or boiler with fresh water inasmuch as the user does not need to carry out complex refilling operations nor to use funnels or auxiliary recipients.

According to a variant, the stopper which closes the refilling aperture of the cover according to the invention also acts as a handle to transport the cover, for example, from the refilling zone to the position above the base.

The invention also has the advantage that, when the cover is in the operating position, the water contained therein is heated by the heat generated by the boiler; it is thus possible to reduce the times needed by the boiler to transform the water into steam.

According to a variant, in order to further reduce the times needed for the transformation of the water into steam, the cover according to the invention cooperates with heating means included for this purpose.

BRIEF DESCRIPTION OF THE DRAWINGS

The attached Figures are given as a non-restrictive example and show a preferential embodiment of the invention as follows.

DETAILED DESCRIPTION OF THE PREFERRED EMBODIMENT

Figure 1:
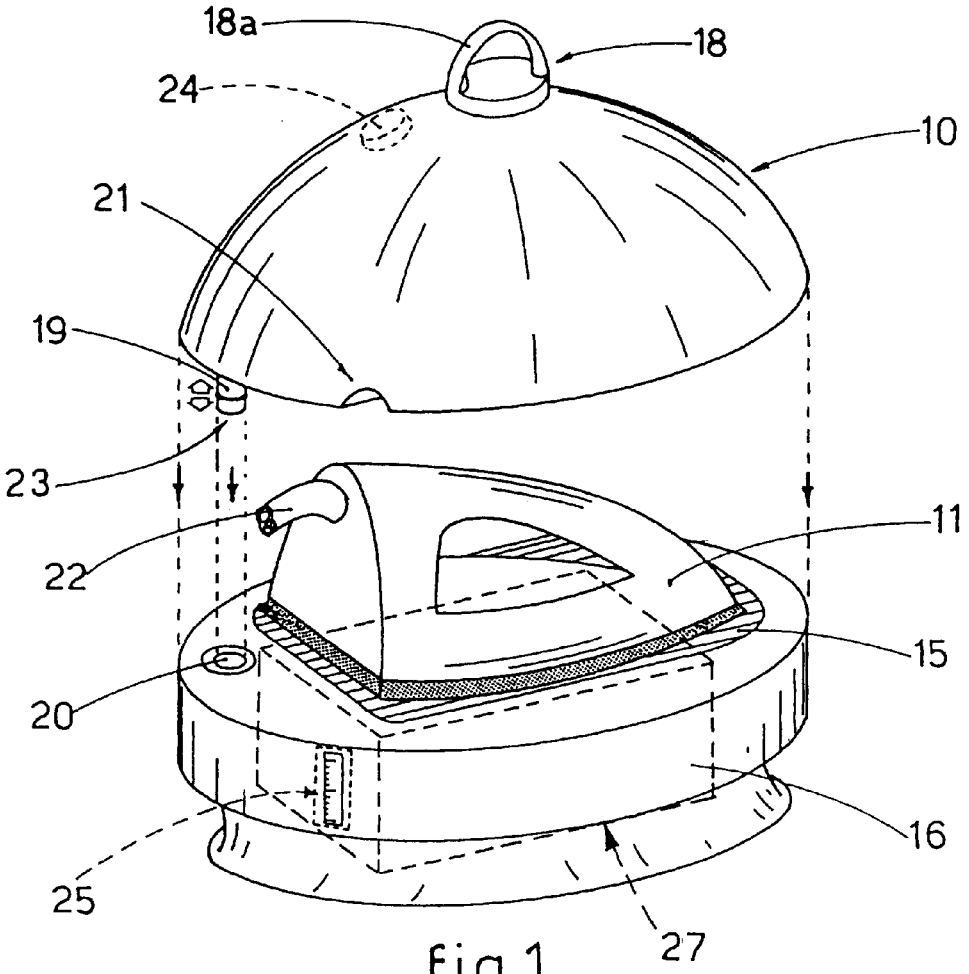
FIG. 1 shows a cover according to the invention during its association with the base of an iron.
Figure 2:
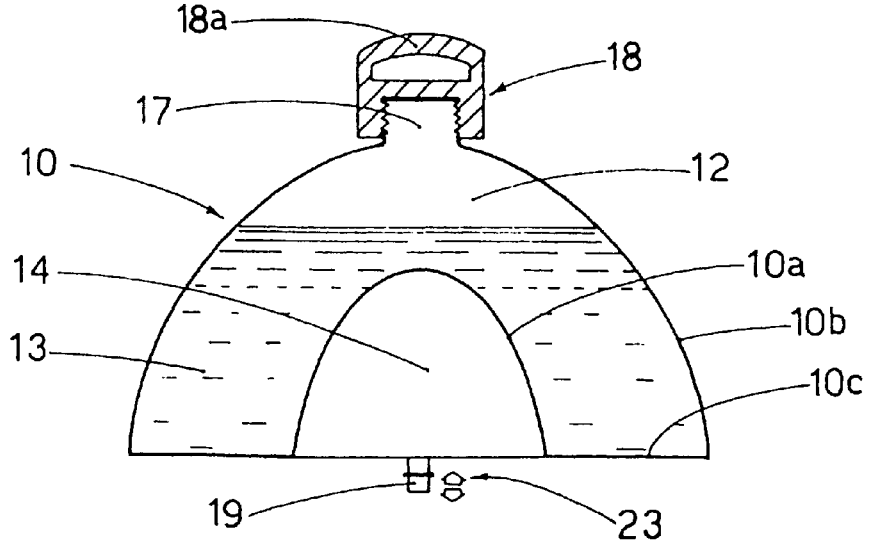
FIG. 2 shows a transverse cross-section of the cover shown in FIG. 1.

The cover 10 according to the invention for irons 11, in this case, is in the shape of a bell defined by an inner wall 10*a* and an outer wall 10*b*, connected by a bottom 10*c*.

The walls 10*a* and 10*b* and the bottom 10*c* define a space 12 to contain water 13, open at the upper part for refilling purposes.

The inner wall 10*a*, moreover, defines a volume 14 which allows the cover 10 to cover the iron 11 when it is rested on the heat resistant plate 15 of the base 16.

The aperture 17 of the space 12 is temporally closed by means of a cover 18, in this case of the screw type and equipped at the upper part with a handle 18*a* which facilitates the transport of the cover 10.

According to a variant, shown in FIG. 1 with a line of dashes, the handle 18*a* is solid with the cover 10 and refilling is carried out through a lateral aperture closed by a stopper 24.

In the following description we shall describe the application for boilers, but the case is the same for tanks containing water at room temperature.

In the latter case, a variant of the invention, shown in FIG. 1 with a line of dashes, includes an indicator 25 of the level of water contained in the water tank at room temperature.

According to the invention, the cover 10 includes, in this case on the bottom 10*c*, adduction means 23 which make it possible to unload the water 13 contained in the space 12 into the steam generation boiler 27 shown in FIG. 1 with a line of dashes.

In this case, the adduction means 23 consist of a nozzle 19 suitable to be inserted in a water-tight manner inside the loading aperture 20 of the boiler 27 when the cover 10 is associated at the upper part of the base 16.

In the preferential embodiment of the invention, the nozzle 19 includes interception means governed by sensors included for this purpose, for example level sensors, pressure sensors, etc., associated with the boiler.

In this embodiment, the water 13 passes from the cover 10 to the boiler 27 through the nozzle 19 every time the sensors detect, for example, that the water in the boiler 27 is finished or has gone below a minimum level.

The nozzle 19 is of the retractable compressible type so that it can be retracted inside the bulk of the cover 10 when the cover 10 is disassociated from the base 16 so as to allow it to rest on a flat surface.

According to a variant, the nozzle 19 is arranged on the base 16 and is associated with an aperture on the cover 10.

According to a variant, the interception means are activated manually by the user when, for example, the light on the iron comes on to signal that there is no more water.

The invention not only eliminates the dead times which we normally find when we refill the boiler, it also considerably simplifies these operations, as the user simply has to refill the cover 10 through a wide aperture 17 which does not require the use of funnels or of special recipients.

Indeed, it is possible to refill the cover 10 directly from the water tap, as the cover 10 is transportable.

In this case, in correspondence with the bottom 10*c*, the cover 10 includes an opening 21 which allows the cable 22 (shown only partly here) of the iron 11 to pass when the iron 11 is rested on the base 16 and covered by the cover 10.

According to a variant which is not shown here, the cover 10 is defined by the outer wall 10*b* alone, which defines a volume which allows the iron 12 to be covered and also houses a tank or basin to contain water 13.

In this embodiment, the adduction means 23, for example the nozzle 19, are associated with the tank or basin by means of a flexible tube.

According to the invention, the heat generated by the boiler 27 contained in the base 16 laps the walls 10*a*, 10*b* and the bottom 10*c* of the cover 10 and heats the water 13 contained in the space 12.

The water 13 fed to the boiler 27, therefore, is already at a temperature high enough to allow a reduction in the times taken to transform the water into steam, and therefore a considerable saving in energy.

According to a variant, in order to further reduce the time taken to transform the water into steam, the cover 10 cooperates with heating means included for this purpose.

I claim:

1. A cover (10) for a steam iron (11) having an outside tank associated with a base (16), comprising a structure defining a part (10*c*) for a selective connection to said base (16) for covering said iron (11) when the latter is not in use, at least a closed volume (12) to contain water (13), and adduction means (23) for selectively connecting said closed volume (12) to said outside tank, wherein said adduction means (23) are selectively activated when a predetermined minimum level of water inside said outside tank has been reached.

2. Cover as in claim 1, wherein the adduction means (23) are activated manually.

3. Cover as in claim 1, wherein the adduction means (23) are activated automatically and are governed by sensors, for example level sensors, pressure sensors, etc.

4. Cover as in claim 1, wherein the closed volume (12) is a space defined by a double wall (10*a*, 10*b*) of the cover (10) itself.

5. Cover as in claim 1, wherein the closed volume (12) is a tank associated inside the cover (10).

6. Cover as in claim 1, wherein the adduction means (23) are a nozzle (19) temporally associated in a water-tight manner with a loading aperture (20) in an operating, or a closed, position of the cover (10).

7. Cover as in claim 1, wherein it includes a filling stopper (18, 24).

8. Cover as in claim 7, wherein the filling stopper (18) includes a handle (18*a*) to transport the cover (10).

9. Cover as in claim 1, wherein it includes at a lower part at least an opening (21) through which a cable (22) connecting the iron (11) with the base (16) passes.

10. Cover as in claim 1, further comprising it includes means to heat the water (13) which is contained in the closed volume (12).

11. Cover as in claim 1, in the closed volume (12) the nozzle (19) is positioned in a retracted position inside of the cover (10).

12. A cover (10) for a steam iron (11) having an outside tank incorporating a boiler (27) associated with a base (16), comprising a structure defining a part (10*c*) for a selective connection to said base (16) for covering said iron (11) when the latter is not in use, at least a closed volume (12) to contain water (13), and adduction means (23) for selectively connecting said closed volume (12) to said boiler (27), wherein said adduction means (23) are selectively activated when a predetermined minimum level of water inside said boiler (27) has been reached.

* * * * *